US009126264B2

(12) United States Patent
Moschini et al.

(10) Patent No.: US 9,126,264 B2
(45) Date of Patent: Sep. 8, 2015

(54) METHOD FOR MANUFACTURING MONOLITHIC HOLLOW BODIES BY MEANS OF A CASTING OR INJECTION MOULDING PROCESS

(75) Inventors: Renzo Moschini, Bologna (IT); Anna Lisa Calzolaro, Bologna (IT)

(73) Assignee: Freni Brembo S.p.A., Curno (IT)

( * ) Notice: Subject to any disclaimer, the term of this patent is extended or adjusted under 35 U.S.C. 154(b) by 408 days.

(21) Appl. No.: 13/509,825

(22) PCT Filed: Nov. 16, 2010

(86) PCT No.: PCT/IB2010/002918

§ 371 (c)(1),
(2), (4) Date: Apr. 10, 2013

(87) PCT Pub. No.: WO2011/061593

PCT Pub. Date: May 26, 2011

(65) Prior Publication Data

US 2013/0199749 A1 Aug. 8, 2013

(30) Foreign Application Priority Data

Nov. 17, 2009 (IT) ..... B02009A0748

(51) Int. Cl.
*B22C 9/12* (2006.01)
*B22C 9/24* (2006.01)
(Continued)

(52) U.S. Cl.
CPC . *B22D 25/02* (2013.01); *B22C 9/10* (2013.01); *B22C 9/12* (2013.01); *B22C 9/24* (2013.01); *B22D 17/00* (2013.01)

(58) Field of Classification Search
CPC ..... B22C 1/00; B22C 1/14; B22C 7/00; B22C 7/02; B22C 9/00; B22C 9/02; B22C 9/04; B22C 9/043; B22C 9/046; B22C 9/10; B22C 9/101; B22C 9/108; B22C 9/12; B22C 9/123; B22C 9/22; B22C 9/24
USPC ..... 164/520, 529
See application file for complete search history.

(56) References Cited

U.S. PATENT DOCUMENTS 3,263,957 A 8/1966 Lirones
3,688,832 A 9/1972 Horton
(Continued)

FOREIGN PATENT DOCUMENTS

EP 0089317 A2 9/1983
EP 0256571 A1 2/1988
(Continued)

OTHER PUBLICATIONS

International Searching Authority/European Patent Office, "International Search Report and Written Opinion of the International Searching Authority," for PCT/IB2010/002918, mailed Apr. 11, 2011, 13 pages.
(Continued)

*Primary Examiner* — Kevin P Kerns
*Assistant Examiner* — Steven Ha
(74) *Attorney, Agent, or Firm* — Haynes & Boone, LLP

(57) ABSTRACT

A method for manufacturing a monolithic hollow body by means of a casting or injection molding process, the manufacturing method contemplating the steps of: producing at least one lost ceramic core that reproduces the shape of at least one internal cavity of the hollow body, introducing the ceramic core inside a first mold that reproduces in negative the external shape of the hollow body, feeding a molten material inside the first mold by means of a casting or injection molding process, letting the material inside the first mold solidify, extracting the hollow body from the first mold, and destroying and removing the ceramic core located inside the hollow body.

15 Claims, 5 Drawing Sheets

(51) Int. Cl.

| | |
|---|---|
| ***B22D 17/00*** | (2006.01) |
| ***B22D 25/02*** | (2006.01) |
| ***B22C 9/10*** | (2006.01) |

(56) References Cited

U.S. PATENT DOCUMENTS

| | | | | |
|---|---|---|---|---|
| 5,320,157 | A * | 6/1994 | Siak et al. | 164/12 |
| 7,798,201 | B2 * | 9/2010 | Bewlay et al. | 164/369 |
| 2007/0023157 | A1 | 2/2007 | Otero et al. | |
| 2007/0131382 | A1 * | 6/2007 | Otero et al. | 164/516 |
| 2009/0174303 | A1 * | 7/2009 | Kanechika et al. | 313/238 |

FOREIGN PATENT DOCUMENTS

| | | | |
|---|---|---|---|
| EP | 0557995 | A1 | 9/1993 |
| EP | 0689912 | A1 | 1/1996 |
| EP | 1293276 | A2 | 3/2003 |
| EP | 1399304 | A1 | 3/2004 |
| GB | 2394221 | A * | 4/2004 |
| JP | 2-188460 | | 7/1990 |
| JP | 06023505 | A | 1/1994 |
| JP | 6-63684 | | 3/1994 |
| JP | 07303935 | A | 11/1995 |
| JP | 2004174512 | A | 6/2004 |
| JP | 2005-205494 | | 8/2005 |

OTHER PUBLICATIONS

Anonymous, "Casting Simulation Solutions ProCast/QuickCast," 2007, ESI Group, URL:http://www.esi-group.com/products/casting/quickcast/benefits/files/Brochure_Casting-2007.pdf; retrieved on Jun. 7, 2010; all pages.

D. Ling, M. Gupta, P.R. Myers, R.K. Upadhyay, "Prediction of Core Deflection in Ceramic Injection Molding," 2005, Proceedings of ANTEC 2005, URL:http://www.me.mtu.edu/mahesh/Papers/ANTEC05_CIM.pdf, retrieved on Jun. 7, 2010, pp. 42-43.

* cited by examiner

METHOD FOR MANUFACTURING MONOLITHIC HOLLOW BODIES BY MEANS OF A CASTING OR INJECTION MOULDING PROCESS

This application is a United States national phase application of co-pending international application number PCT/IB2010/002918, filed Nov. 16, 2010, which claims the benefit of Italian application number BO2009A000748, filed Nov. 17, 2009, each of which is incorporated herewith in its entirety.

BACKGROUND OF THE INVENTION

1. Technical Field

The present invention relates to a method for manufacturing monolithic hollow bodies by means of a casting or injection moulding process. The term "casting" in intended as indicating high-pressure casting processes ("pressure die casting"), low-pressure casting processes (approximately 1-2 bar) and gravity casting processes (including casting processes with sand moulds and casting processes with metal or "shell" moulds).

The present invention finds advantageous application in the manufacture of articles for use in the automotive sector, to which the treatment that follows shall make explicit reference, but without any loss of generality.

2. Prior Art

The advantages deriving from making manufactured articles in metal alloys by means of pressure die casting or in polymeric materials by means of injection moulding are well known.

These processes enable high industrial productivity deriving from very low moulding cycle times, the production of thin thicknesses (2-3 mm) and achieving finished shapes ("net-shape" or "near-net-shape") due to the effect of injecting under pressure into metal moulds; in substance, these procedures enable the manufacture of low-cost articles for mass production and types of production commonly used in the automotive sector.

However, significant limits exist regarding the manufacturing processes of articles for which hollow and geometrically complex shapes are required: limits represented by the need of having to use only metal cores that, as they must be constrained to the mould, necessitate being extracted from the manufacture article by withdrawal before ejection of the piece. Thus, due to the requirement of being extractable, these cores do not allow the production of undercuts and so, ultimately, design flexibility is significantly penalized in terms of the internal geometric configuration of the pieces to be made. The use of metal cores is necessary in pressure die casting processes because high mechanical strength is required to support the heavy stresses exerted by liquid metals or technopolymers during the steps of filling the mould and the considerable compression pressures (500-1500 bar) during solidification of the piece.

All the same, obtaining hollow monolithic bodies in metal materials is feasible with casting techniques that do not require high moulding pressures, such as gravity casting for example and which, given the lack of particular stress in the casting step, permit the use of sand cores, which can be removed from the casting after the step of ejecting the piece from the mould with known and conventional methods of thermal, mechanical and/or chemical removal. Obviously, in the case of these casting techniques, the components produced still lose the previously-described advantages deriving from the use of high moulding pressures, especially in terms of weight (the minimum thickness of the walls is 5 mm) and cost (due to the considerable lengthening of production times).

In the case of polymeric materials, there are known techniques that allow the production of hollow monolithic bodies (even in the presence of high moulding pressures) by means of, for example, the use of fusible metal cores: however, in this case, the prohibitive industrial costs of the technology have effectively prevented mass industrial development.

In recent years, some of the limits mentioned above have been overcome in the automotive sector: in fact, pressure-die-cast aluminium solutions have been developed based on the production of castings characterized by undercuts made by means of cores in a refractory material of sufficient mechanical strength (produced with the shell-moulding technology for example) able to adequately resist the stresses exerted by the molten metal during the moulding process of the castings. On the other hand, this has been made possible through the onerous utilization of special semi-solid casting processes (known as "rheocasting") that enable the injection of molten metal at low velocities, thereby significantly reducing the tensional stresses in play.

Although adequate in relation to certain specific applications, the mechanical strength values of the cores employed are, in any case, generally limited (10-15 MPa at most) and, in consequence, the mould filling conditions are still restrictive (in terms of gate positioning and injection parameters) in order not to compromise the structural stability of the cores themselves.

The methods of consolidation of these cores are based on the utilization of organic or inorganic binders that, under the effect of temperature, enable the cohesion of the refractory powders in which they are mixed. According to the various technologies in use, these binders can be added separately to the refractory material or can constitute an integral part (precoated powders). In any case, the bonds are relatively weak and, in consequence, the mechanical characteristics of the cores cannot offer particularly good performance and are therefore not suitable for all applications.

In addition, the organic binders generate gases during casting that must be adequately evacuated to prevent them remaining trapped inside the mould and causing the formation of undesired porosity in the metal. Furthermore, organic binders have quite a significant environmental impact, while on the other hand they are not soluble in water (unlike inorganic binders) and removal of the corresponding cores requires heat treatment on the castings or energetic mechanical action by hammering on the actual castings. Unlike cores using organic binders, cores using inorganic binders have the advantage of not generating gas residues in the casting step; however, such cores using inorganic binders are only made as solid ones, by means of processes (for example, the so-called "hot box") that do not allow shell cores to be obtained.

U.S. Pat. No. 5,387,280A1 describes the utilization of a lost ceramic core for a casting process of the "investment casting" type; the ceramic core comprises a high percentage (between 20% and 50% by weight) of acid-soluble borate binder and therefore acids are used for removing the ceramic core after forming the piece. However, the use of acids for core removal has a non-trivial environmental impact, especially when a large number of pieces are produced, as occurs in the automotive sector (where the production of more than a million pieces every year is not infrequent).

Patent applications JP06023505A and EP1293276A2 describe the utilization of lost sintered ceramic cores in casting processes. However, the removal of ceramic cores produced according to these patent applications is normally complex, and therefore expensive.

U.S. Pat. No. 3,688,832A1 describe the utilization of lost ceramic cores in casting processes. To strengthen and harden the ceramic cores (to be able to use these ceramic cores in pressure die casting processes) and at the same time to enable simple removal of the ceramic cores from the finished piece after the casting process, the ceramic cores are impregnated beforehand with a hot mixture of at least one organic compound that has a melting point not below 77° C., can be melted to a liquid state and then resolidified following cooling, has a density of at least 1 gram per milliliter and volatilizes (vaporizes) when heated beyond its melting point. Before the ceramic cores are used in the casting process, they are heated to volatilize the organic impregnant through the pores of the ceramic cores. However, the use of organic compounds to impregnate the ceramic cores beforehand considerably increases the environmental impact of the process, as these organic compounds are highly polluting. In addition, the ceramic cores must be heated to volatilize the organic impregnant in a sealed environment that allows all fumes to be recovered, after which they must be adequately treated and not discharged into the atmosphere, with a significant impact on the overall cost of the process. Organic impregnant may remain in the ceramic cores and then volatilize inside the mould, generating gas that can cause the formation of undesired porosity in the metal. In addition, the ceramic cores produced in this way have a high surface porosity and therefore the molten metal that is fed under pressure into the mould tends to penetrate quite deeply inside the ceramic core (even up to 1-1.5 mm); this is big drawback because it makes removal of the ceramic core from inside the metal piece more complex and makes the surface of the metal piece that has been in contact with the ceramic core much rougher.

DESCRIPTION OF INVENTION

The object of the present invention is to provide a method for manufacturing monolithic hollow bodies by means of a casting or injection moulding process that is devoid of the above-described drawbacks and, at the same time, is easy and inexpensive to produce.

According to the present invention, a method is provided for manufacturing monolithic hollow bodies by means of a casting or injection moulding process in accordance with that asserted by the enclosed claims.

BRIEF DESCRIPTION OF DRAWINGS

The present invention shall now be described with reference to the attached drawings, which illustrate a non-limitative embodiment, where.

PREFERRED EMBODIMENTS OF THE INVENTION

Figure 1:
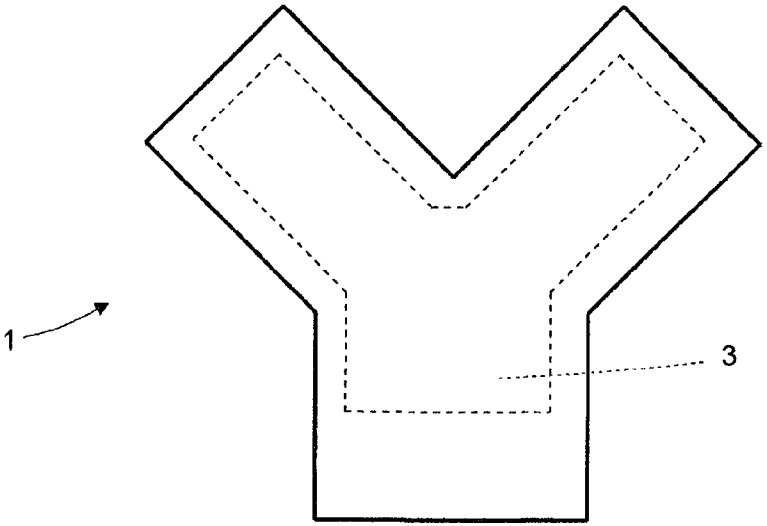
FIG. 1 is a schematic view of a monolithic hollow body, in particular of an engine block of an internal combustion engine, produced by means of the manufacturing method of the present invention.

In FIG. 1, reference numeral 1 indicates, in its entirety, a monolithic hollow body, in particular an engine block of an internal combustion engine made of pressure die cast aluminium alloy.

Figure 2:
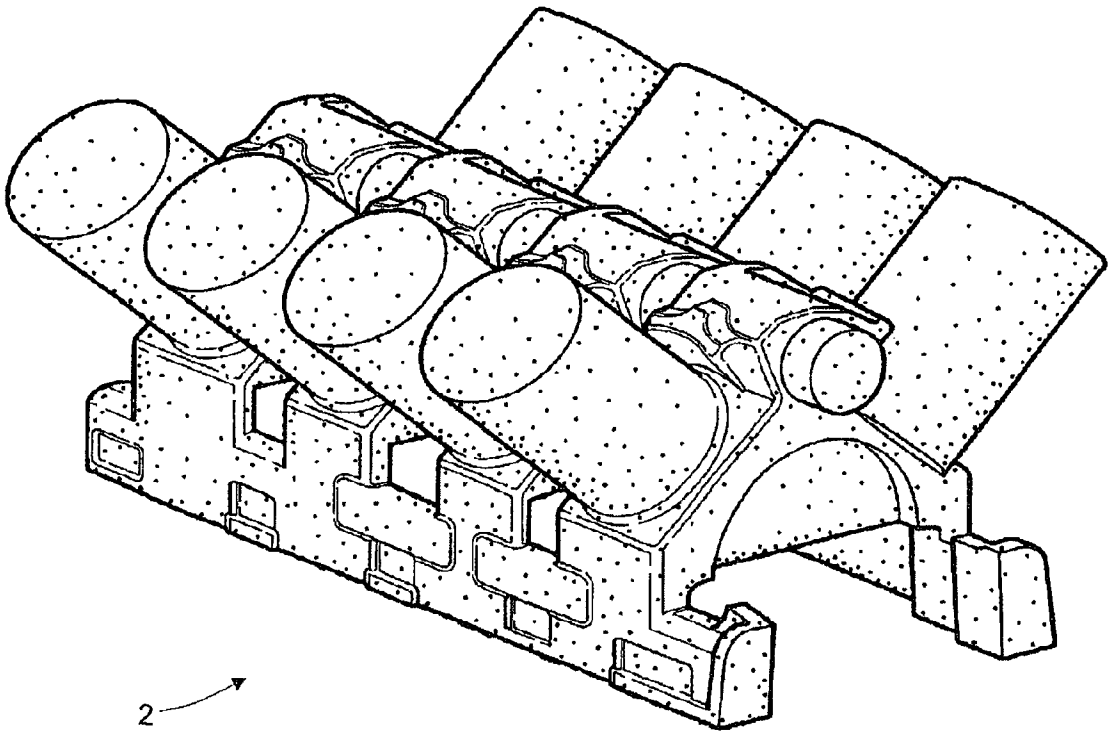
FIG. 2 is a schematic and perspective view of a ceramic core used in the production of the monolithic hollow body in FIG. 1.
Figure 3:
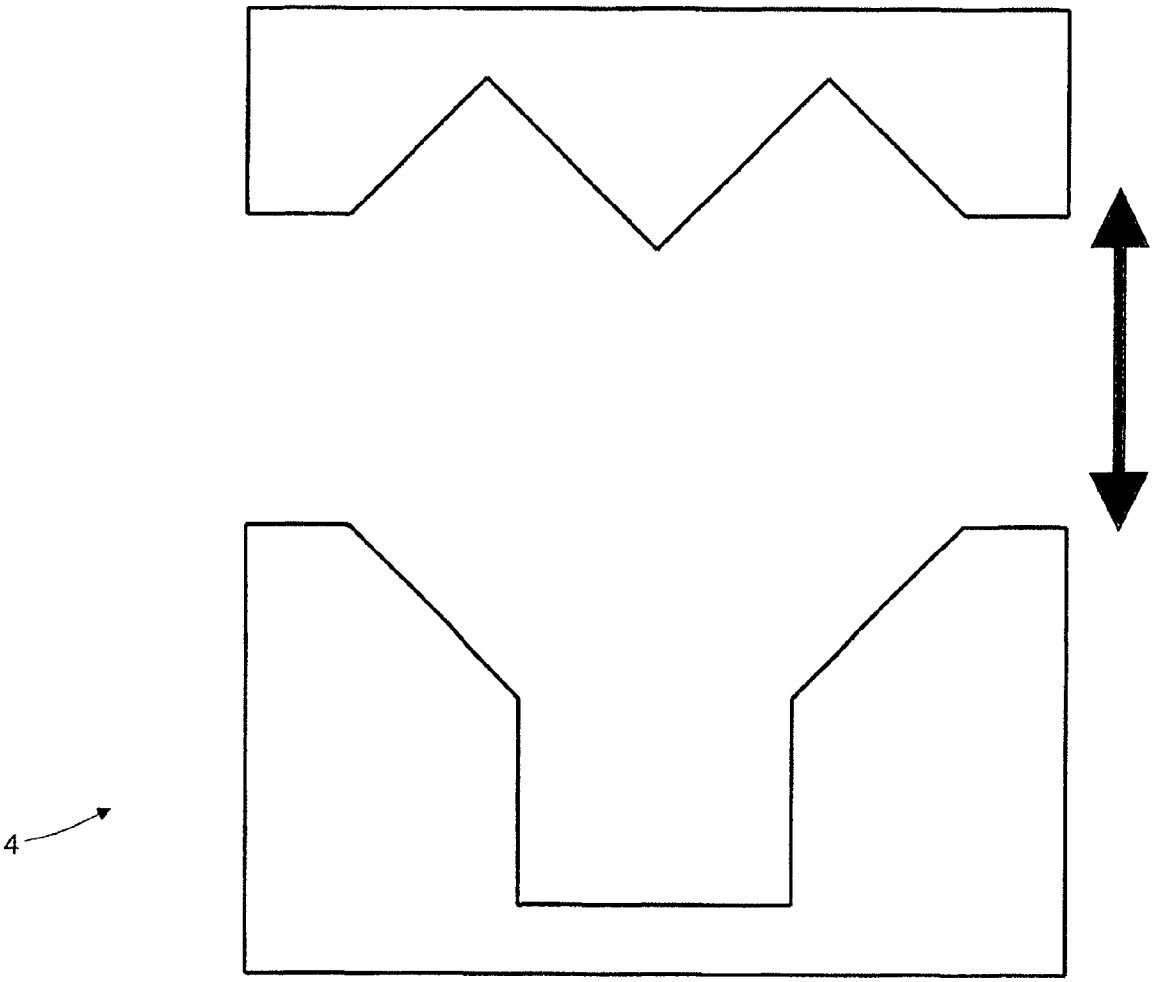
FIG. 3 is a schematic view of a first mould used in the production of the monolithic hollow body in FIG. 1.

The manufacturing process of the hollow body 1 contemplates making at least one lost ceramic core 2 (shown in FIG. 2) that reproduces the shape of at least one internal cavity 3 of the monolithic hollow body 1, introducing the ceramic core 2 inside a mould 4 (shown in FIG. 3) that reproduces in negative the external shape of the hollow body 1, feeding (casting) an aluminium alloy inside the mould 4 by means of a pressure die casting process, letting the aluminium alloy inside the mould 4 solidify, extracting the hollow body 1 from the mould 4 by opening the mould 4 and, lastly, destroying and removing the ceramic core 2 located inside the hollow body 1.

When the hollow body 1 is produced using a metal material, the feeding of the molten metal material inside mould 4 contemplates using a casting process (which can for example be a gravity shell casting or a pressure die casting). Instead, when the hollow body 1 is produced using a polymeric plastic material (typically technopolymers), the feeding of the molten polymeric plastic material inside the mould 4 contemplates using an injection moulding process.

Preferably, the destruction and then the subsequent removal of the ceramic core 2 from inside the hollow body 1 contemplates using known mechanical methods (typically by means of high-pressure water jets) possibly combined with known chemical methods (chemical leaching), which are applied at the end for final cleaning of the hollow body 1.

Figure 4:
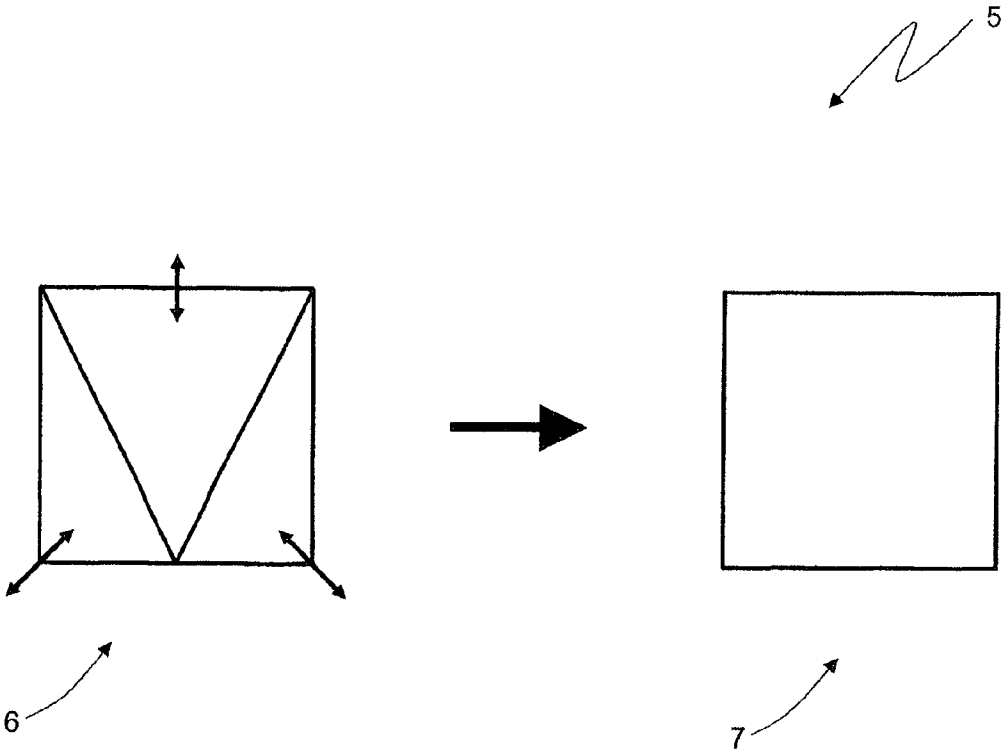
FIG. 4 is a schematic view, with the removal of details for clarity, of a production plant for the ceramic core in FIG. 2.

FIG. 4 schematically shows a production facility 5 for the ceramic core 2. First of all, the "green" ceramic core 2 is formed using one of the known production methods for moulding ceramic manufactured articles, with the choice of the most suitable production method depending on the geometry and mechanical characteristics of the core 2 to be formed. With regards to applications in the automotive sector, it has been observed that the production method that has the biggest advantages is the "slip-casting" process, in which a slip is fed under pressure inside a porous mould 6 that reproduces in negative the external shape of the ceramic core 2.

The porous mould 6 consists of the union of multiple parts (for example, three as shown in FIG. 4) that are carried by respective tables of a press, which has the task of closing and opening the porous mould 6. The slip, consisting of a suspension of ceramic material in an aqueous solution, is cast inside the closed porous mould 6 at pressures of 10-20 bar, such that the slip's liquid phase is expelled through the pores of the porous mould 6, while the solid (ceramic) phase is kept against the inner walls of the porous mould 6, thereby identifying the shape of the ceramic core 2 to be produced.

Examples of "slip-casting" processes are provided in patent applications EP0089317A1, EP0256571A1, EP0557995A1 EP0689912A1 and EP1399304A1.

Alternatively, instead of using the "slip-casting" process to form the "green" core 2, it is possible to use other known moulding processes such as CIM (Ceramic Injection Moulding) for example, or simple axial pressing (which has the advantage of being quick and particularly inexpensive in the case of high or very high volumes, but on the other hand only allows simple, solid forms to be produced).

Once the "green" ceramic core 2 has been formed in the porous mould 6, the porous mould 6 is opened and the "green" ceramic core 2 is transferred to an oven 7 for heat treatment. It is important to note that when the "green" ceramic core 2 is extracted from the porous mould 6, it is damp and therefore has minimal mechanical characteristics, only sufficient for supporting the handling operations for being fed to the oven 7. The heat treatment (i.e. the heating) that takes place in the oven 7 gives the ceramic core 2 its final mechanical characteristics for utilization inside the mould 4.

After the heating process in the oven 7, it is possible (even if extremely rare) that the ceramic core 2 is impregnated with refractory plaster (normally available on the market) able to fill the residual porosity of the ceramic core 2 so as to prevent the liquid metal melt material from infiltrating into the surface of the ceramic core 2 (even if limited to a depth of less than 1 mm) during the compression step of the hollow body 1 after the mould 4 has been filled. This facilitates subsequent shake-out operations (i.e. removal of the ceramic core 2 from inside the hollow piece 1) and improves the surface characteristics of the metal interface after removal from the ceramic core 2.

In accordance with the present invention, the mechanical stresses on the ceramic core 2 when the core 2 is handled (i.e. when transferring the core 2 from the oven 7 to inside the mould 4) and when molten material (i.e. molten aluminium alloy) is fed inside the mould 4 are estimated in advance. Obviously, in the case of a gravity shell casting, the mechanical stresses on the ceramic core 2 when molten material is fed inside the mould 4 are limited and therefore potentially smaller that the mechanical stresses on the ceramic core 2 when the core 2 is handled. It is important to remember that the ceramic core 2 is highly resistant to compression, but is also very "fragile", i.e. it is unlikely to break if compressed, but can easily shatter after even just light impact (especially when the ceramic core 2 has a complex shape with small-sized projecting appendages). Instead, in the case of pressure casting (i.e. pressure die casting) with high pressures, the mechanical stresses on the ceramic core 2 when molten material is fed inside the mould 4 are always greater than the mechanical stresses on the ceramic core 2 when the core 2 is handled.

The mechanical stresses on the ceramic core 2 when the core 2 is handled are preferably estimated experimentally: the mechanical stresses on the ceramic core 2 when the core 2 is handled are constant and repeatable (the handling process is standard), and therefore can be easily and rapidly estimated through experimental tests.

The mechanical stresses on the ceramic core 2 when molten material is fed inside the mould 4 are preferably estimated by means of numeric calculation methodologies that provide finite element analysis which allows a simulation of the casting process to be obtained; to carry out the numeric calculation methodologies it is possible, for example, to use commercially available software, such as "PROCAST" (™ from ESI Group), distributed by ESI Group (http://www.esi-group.com/products/casting/procast). It is important to note that the estimate provided by the numeric calculation methodologies of the mechanical stresses on the ceramic core 2 when molten material is fed inside the mould 4 can be also confirmed and refined by experimental tests.

Once the mechanical stresses on the ceramic core 2 when the core 2 is handled and when molten material (i.e. molten aluminium alloy) is fed inside the mould 4 have been estimated, a firing temperature for the "green" ceramic core 2 is established that will give the ceramic core 2 a mechanical strength slighter higher than the maximum mechanical stresses on the ceramic core 2 when the core 2 is handled and when molten material is fed inside the mould 4. Finally, the "green" ceramic core 2 is heated in the oven 7 to a temperature equal to the previously established firing temperature.

The firing temperature can be less than a sintering threshold and therefore the firing in the oven 7 only causes the drying of the "green" ceramic core 2 (i.e. the loss of liquids present inside ceramic core 2 as a consequence of the manufacturing process of the ceramic core 2). Alternatively, the firing temperature can be higher than the sintering threshold and therefore the firing in the oven 7 also causes the (typically partial) sintering of the "green" ceramic core 2; the sintering mechanisms that take place in the oven 7 cause the diffusion welding of individual particles of ceramic material constituting the ceramic core 2 and gives the ceramic material high mechanical strength. It is important to underline that the sintering of the "green" ceramic core 2 is normally "partial", i.e. it does not affect all of the ceramic material, but only a part of the ceramic material (the greater the firing temperature, the greater will be the part of the ceramic material that is sintered).

In a preliminary phase of analysis, it is necessary to determine how the mechanical strength (in particular, the bending strength measured in MPa) of the ceramic core 2 changes as the firing temperature varies. Operationally, one proceeds experimentally by initially defining the chemical composition of the ceramic mixture and then producing test pieces for carrying out mechanical tests; the various test pieces are then subjected to different firing temperatures to identify the correlation with the mechanical bending characteristics.

Figure 5:
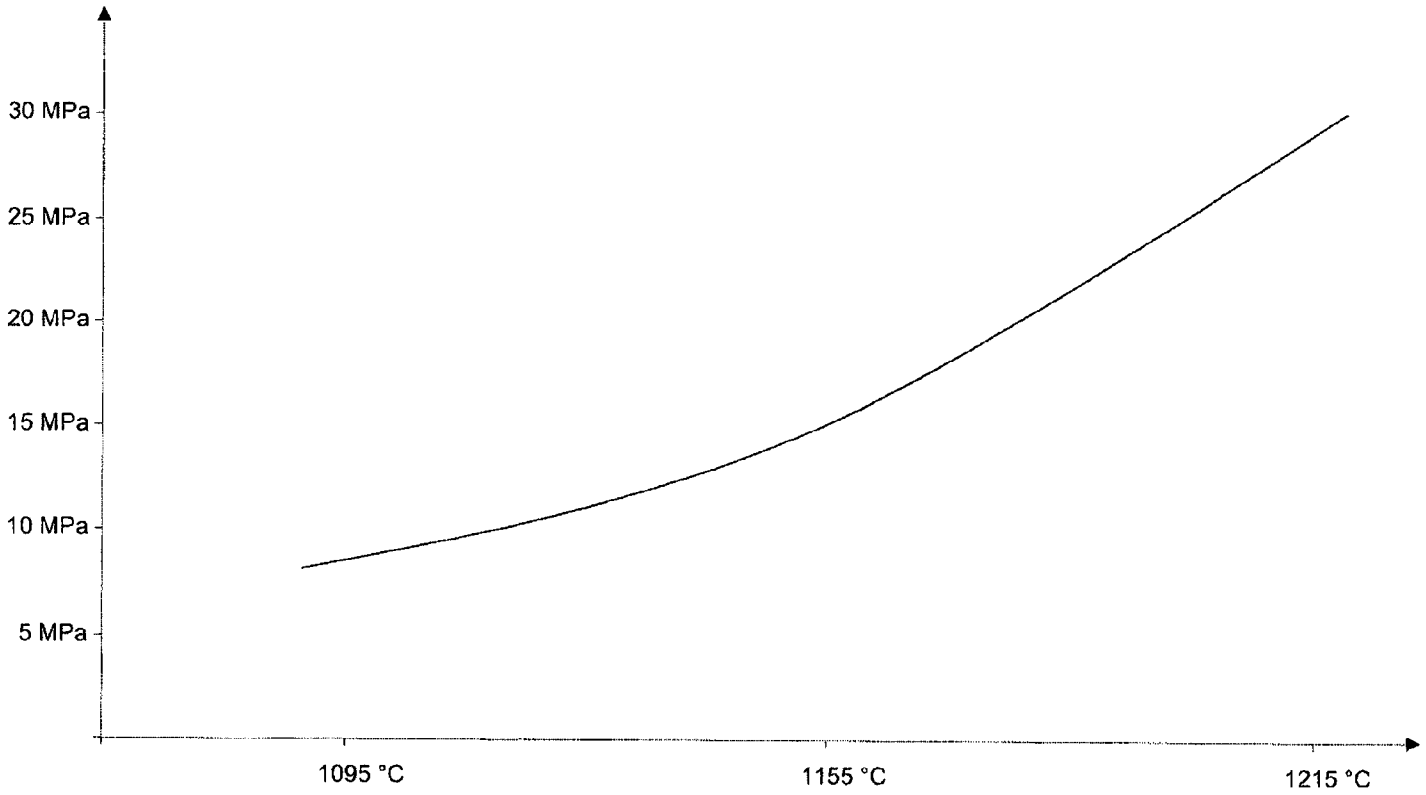
FIG. 5 is a graph that shows experimental data on the variation in mechanical strength of the ceramic core in FIG. 2 as the sintering temperature varies.

By way of example, FIG. 5 shows a graph indicating the variation in mechanical strength (expressed in MPa) of a silica-based ceramic core 2 as a function of the firing temperature when the firing temperature is higher than the sintering threshold; it can be noted that it is possible to obtain wide variations in mechanical strength with small variations in firing temperature. Instead, when the firing temperature is less than the sintering threshold, even large variations in firing temperature only cause small changes in mechanical strength.

Experimental tests have shown that for the best results in producing the ceramic core 2 are obtained when using a silica-based ceramic material (e.g. quartz) with the addition of clay (the addition of clay permits improved the rheological properties); inter alia, the silica-based ceramic material is chemically attacked by hydroxides (such as potassium hydroxide) and therefore also lends itself to chemical leaching. According to a preferred embodiment, the best ceramic material for making the ceramic core 2 is composed of a mixture consisting of 45% to 55% quartz (i.e. silica, or rather $SiO_2$), 20% to 25% clay (i.e. silica, alumina and other substances) and 25% to 30% kaolin (i.e. silica, alumina and water). When subjected to partial sintering, this mixture has limited porosity, which prevents the molten metal fed under pressure from penetrating significantly inside the ceramic core 2 (the penetration of molten metal is less than 0.1-0.2 mm); in this way, it is simpler to remove the ceramic core 2 from inside the hollow body 1 and the surfaces of the hollow body 1 that have been in contact with the ceramic core 2 are very smooth (and so by using this material, impregnation with refractory plaster is normally unnecessary). Furthermore, when subjected to mechanical stresses during removal (for example, by means of pressurized water jets) this mixture tends to pulverize (i.e. it forms very small fragments), unlike other ceramic materials that tend to form relatively large-sized splinters; in this way, it is simpler to remove the ceramic core 2 from inside the hollow body 1.

It is important to underline that no type of organic or inorganic binder is used for forming the "green" ceramic core 2, nor is any type of organic or inorganic impregnant used (in rare cases, impregnation is carried out with refractory plaster and an inorganic impregnant only after firing and therefore when the ceramic core 2 is no longer "green"); in this way, the entire casting process has a very moderate environmental impact (the only waste of the casting process consists of ceramic powder (which is completely inert) generated by the mechanical destruction of the ceramic core 2.

The ceramic core 2 produced as described above is able to achieve the mechanical characteristics required for the moulding process of the hollow body 1 (taking into account both the handling of the ceramic core 2 and feeding the molten material inside the mould 4) with a predetermined, and in any case settable, minimum safety margin. In this way, the ceramic core 2 correctly resists in the casting or injection moulding process and, at the same time, has the minimum possible resistance to subsequent destruction and removal from inside the hollow body 1. Furthermore, the ceramic core 2 produced as described above is able to achieve the mechanical characteristics (in terms of bending and compression strength in particular) required for the moulding process of the hollow body 1 without the need of using onerous casting support techniques to keep mechanical stress on the ceramic core 2 at low levels through methods of filling the mould 4 at low velocities.

To summarize, in accordance with the present invention, to produce the ceramic core 2 a ceramic material is used for which the mechanisms of hardening and thus of structural resistance are mainly based of the firing process; in this way, it is possible to obtain a very wide range of mechanical characteristics based on the firing temperature without the characteristic limits due to the presence of organic or inorganic binders.

Furthermore, in accordance with the present invention the ceramic core 2 has the minimum possible mechanical strength (i.e. it's mechanical strength is slightly higher than the maximum mechanical stresses on the ceramic core 2 when the ceramic core 2 is handled and when molten material is fed inside the mould 4); in this way, the subsequent destruction and removal of the ceramic core 2 from the finished hollow body 1 is relatively simple and can be performed both rapidly and without running the risk of damaging the hollow body 1. In other words, it is not expedient, or rather it is damaging, to employ an excessively strong ceramic core 2 in relation to what is effectively required. In fact, after the moulding process of the hollow body 1, it is still necessary to remove ("shakeout") the ceramic core 2 and therefore it is opportune to set a firing temperature able to give mechanical characteristics only just sufficient for each specific application.

It is important to note that when the hollow body 1 is produced using a metal material, the feeding of molten metal material inside the mould 4 contemplates using a pressure die casting process, which causes high mechanical stresses on the ceramic core 2 due to the high inlet velocity of the molten metal material (around 30-60 m/sec). Instead, when the hollow body 1 is produced using a polymeric plastic material (typically technopolymers), the feeding of the molten polymeric plastic material inside the mould 4 contemplates using an injection moulding process, which causes high mechanical stresses on the ceramic core 2 due to the high viscosity of the molten polymeric plastic material (much higher than the viscosity of molten metal material), even in the presence of low inlet velocities for the molten polymeric plastic material (around a few m/sec).

It is important to underline that a ceramic core 2 has an adequate modulus of elasticity, as the ceramic material tends to shatter rather than deform; this characteristic is very positive, as it ensures that the ceramic core 2 does not undergo deformation during casting, which would alter the shape of the internal cavity 3 of the monolithic hollow body 1 in an undesired manner. In other words, a ceramic core 2 could shatter during the casting owing to mechanical stresses (in this case, the monolithic hollow body 1 must be rejected and the defectiveness is absolutely evident and noticeable, even with a simple visual check and therefore cannot go undetected), but a ceramic core 2 does not deform during casting (in the event of slight deformation, the monolithic hollow body 1 must be rejected, but defectiveness is difficult to detect and requires very accurate and complex-to-perform measurement).

Finally, it is important to note that the ceramic cores 2 can be solid or hollow inside. A solid ceramic core 2 has greater mechanical strength (but on the other hand uses a larger amount of ceramics for its production) and is used when the feed (casting) pressure of molten material into the mould 4 is relatively high, while a hollow ceramic core 2 has less mechanical strength (and has the advantage of using a smaller amount of ceramic material for its production) and is used when the feed (casting) pressure of molten material into the mould 4 is lower.

The above-described manufacturing method has numerous advantages, as it is of simple and inexpensive embodiment and, above all, allows monolithic hollow bodies to be made in metal or polymeric materials by means of high-pressure processes (i.e. pressure die casting or injection moulding) without setting constraints on the internal geometries, or rather without limiting the design of hollow bodies.

The invention claimed is:

1. A method for manufacturing a monolithic hollow body by means of a casting or injection moulding process, the manufacturing method comprising the steps of:

producing at least one lost ceramic core that reproduces the shape of at least one internal cavity of the hollow body by forming the "green" ceramic core and successively heating the "green" ceramic core to a firing temperature;

introducing the ceramic core inside the first mould which reproduces in negative the external shape of the hollow body;

feeding a molten material inside the first mould by means of a casting or injection moulding process;

letting the material inside the first mould solidify; and extracting the hollow body from the first mould; and destroying and removing the ceramic core located inside the hollow body;

wherein producing the at least one lost ceramic core comprises the further steps of:

determining how the bending mechanical strength of the ceramic core changes as firing temperature varies;

estimating in advance the mechanical stresses on the ceramic core when the ceramic core is handled and when the molten material is fed inside the first mould; and establishing, as a function of the mechanical stresses on the ceramic core when the core is handled and when molten material is fed inside the mould and as a function of how the bending mechanical strength of the ceramic core changes as firing temperature varies, a firing temperature for the "green" ceramic core that allows the ceramic core to gain a mechanical strength that is higher, with a predetermined minimum safety margin, than the maximum mechanical stresses on the ceramic core when the ceramic core is handled and when the molten material is fed inside the first mould such that the ceramic core correctly resists in the casting or injection moulding process and, at the same time, has the minimum possible resistance to subsequent destruction and removal from inside the hollow body, and wherein heating the "green" ceramic core to a firing temperature comprises heating the "green" ceramic core to a firing temperature that is equal to the previously established firing temperature to give the ceramic core its final mechanical characteristics for utilization inside the first mould, wherein a ceramic material used to produce the ceramic core is constituted by 45% to 55% of quartz, 20% to 25% of clay and 25% to 30% of kaolin.

2. The manufacturing method according to claim 1 and comprising the further step of forming the "green" ceramic core by means of a slip-casting procedure in which a slip is fed under pressure inside a second porous mould which reproduces in negative the external shape of the ceramic core.

3. The manufacturing method according to claim 1 and comprising the further step of estimating the mechanical stresses on the ceramic core when the molten material is fed inside the first mould by means of numeric calculation methodologies that enable simulation of the moulding process.

4. The manufacturing method according to claim 3, wherein the numeric calculation methodologies contemplate finite element analysis.

5. The manufacturing method according to claim 1, wherein a ceramic material used to produce the ceramic core is silica-based.

6. The manufacturing method according to claim 5, wherein a ceramic material used to produce the ceramic core also contains clay.

7. The manufacturing method according to claim 1, wherein the "green" ceramic core is formed without using any organic or inorganic binding material and/or without using any organic or inorganic impregnating material.

8. The manufacturing method according to claim 1 and comprising the further step of impregnating the ceramic core, after the firing process, with a refractory plaster able to fill the residual porosities of the ceramic core, so that the liquid melt material is prevented from infiltrating into the superficial part of the ceramic core.

9. The manufacturing method according to claim 1, wherein the firing temperature is lower than a sintering threshold and only causes the drying of the "green" ceramic core.

10. The manufacturing method according to claim 1 wherein the firing temperature is higher than a sintering threshold and causes the sintering of the "green" ceramic core.

11. A method for manufacturing a monolithic hollow body by means of a casting or injection moulding process, the manufacturing method comprising the steps of:

producing at least one lost ceramic core that reproduces the shape of at least one internal cavity of the hollow body by forming the "green" ceramic core;

introducing the ceramic core inside a first mould which reproduces in negative the external shape of the hollow body; and feeding a molten material inside the first mould by means of a casting or injection moulding process; letting the material inside the first mould solidify; and extracting the hollow body from the first mould; and destroying and removing the ceramic core located inside the hollow body; and wherein producing at least one lost ceramic core comprises:

determining how the bending mechanical strength of the ceramic core changes as firing temperature varies;

estimating the mechanical stresses on the ceramic core when the ceramic core is handled and when the molten material is fed inside the first mould;

establishing, in advance, a firing temperature for the "green" ceramic core that allows the ceramic core to gain a mechanical strength that is higher, with a predetermined minimum safety margin, than the maximum mechanical stresses on the ceramic core when the ceramic core is handled and when the molten material is fed inside the first mould; and heating the "green" ceramic core to the established firing temperature to sinter the ceramic core and to give the ceramic core its final mechanical characteristics for utilization inside the first mould, wherein the ceramic core is constituted by 45% to 55% of quartz, 20% to 25% of clay, and 25% to 30% of kaolin.

12. The manufacturing method according to claim 11, further comprising estimating the mechanical stresses on the ceramic core when the molten material is fed inside the first mould by means of a numeric calculation methodology that enable simulation of the moulding process.

13. The manufacturing method according to claim 12, wherein the numeric calculation methodology comprises finite element analysis.

14. The manufacturing method according to claim 11, wherein the established firing temperature is lower than a sintering threshold.

15. The manufacturing method according to claim 11, wherein the established firing temperature is higher than a sintering threshold and causes the sintering of the "green" ceramic core.

* * * * *